United States Patent [19]

Swift

[11] 4,182,479

[45] Jan. 8, 1980

[54] MAILBOX SIGNAL

[76] Inventor: Logan D. Swift, 518 Starlinder Dr., Nashville, Tenn. 37209

[21] Appl. No.: 955,596

[22] Filed: Oct. 30, 1978

[51] Int. Cl.[2] ..... B65D 91/00

[52] U.S. Cl. ..... 232/35; 232/34

[58] Field of Search ..... 232/34, 35

[56] References Cited

U.S. PATENT DOCUMENTS

| | | | |
|---|---|---|---|
| 2,581,880 | 1/1952 | Price | 232/35 |
| 2,613,031 | 10/1952 | Joyce | 232/35 |
| 2,808,982 | 10/1957 | Armstrong | 232/35 |
| 3,523,639 | 8/1970 | Wiebe | 232/35 |
| 3,572,581 | 3/1971 | McLeod | 232/35 |
| 3,750,939 | 8/1973 | Hallett | 232/35 |
| 3,794,240 | 2/1974 | Myers | 232/35 |

*Primary Examiner*—Ramon S. Britts
*Assistant Examiner*—Peter A. Aschenbrenner
*Attorney, Agent, or Firm*—Harrington A. Lackey

[57] ABSTRACT

A mailbox signal including a flag member journaled beneath the mailbox and adapted to be held in its elevated inoperative position by a latch member, also mounted beneath the mailbox and adapted to be actuated by the rearward swinging movement of the bottom portion of the mailbox door when swung to an open position, for disengaging the flag member and permitting it to drop to a visibly exposed operative position.

The invention also contemplates an extended signal member pivotally mounted upon the free end portion of the flag member and adapted to swing between a folded elevated inoperative position and an extended depending operative position.

The invention further contemplates the inclusion of an electrical signal circuit having a switch member adapted to be actuated by a portion of the flag member when swung to its operative position.

5 Claims, 5 Drawing Figures

MAILBOX SIGNAL

BACKGROUND OF THE INVENTION

This invention relates to a mailbox, and more particularly to a mailbox door-actuated signal device.

Mailbox signals of various designs are known in the art, as illustrated by the following U.S. Pat. Nos.:

2,581,880, Price, Jan. 8, 1952,
3,150,361, Conigliaro, Sept. 22, 1964,
3,559,878, Roeder, Feb. 2, 1971,
3,572,581, McLeod, Mar. 30, 1971,
3,648,924, Burns, Mar. 14, 1972,
3,650,464, Lewis, Mar. 21, 1972,
3,750,939, Hallett, Aug. 7, 1973,
3,815,811, Harmon, June 11, 1974.

Although some of the above patents disclose mailbox signals which are actuated by the bottom portion of the mailbox door, when swung to an open position, nevertheless, either the actuating mechanisms or signal devices themselves extend laterally beyond the walls or the closed door of the mailbox to expose such components to the weather. Where any part of the signal device or its actuating mechanism is exposed to the weather elements, and particularly moisture at below-freezing temperatures, such parts can become frozen to parts of the mailbox or to each other to obstruct the normal operation of the signal device.

Moreover, where parts of the signal device or actuating mechanism project beyond the lateral confines of the mailbox, they are unnecessarily exposed to view to impair the aesthetic appearance of the mailbox; to provide an obstacle for handling the mail, either by the postman or the homeowner; to provide unecessary projections which might be hazardous to safety; or to invite vandalism.

Furthermore, prior art signals or their actuating mechanisms which are located inside the mailbox interfere with the handling of the mail by the postman or by the homeowner. Moreover, such signal devices which are located on the exterior of the mailbox, either on the side or top walls, might sometimes be confused with the conventional signal flag normally pivotally supported upon a mailbox.

SUMMARY OF THE INVENTION

It is therefore an object of this invention to provide a mailbox signal which will overcome the above enumerated disadvantages of those signal devices forming a part of the prior art.

The signal device made in accordance with this invention includes a flag member and a door-actuated mechanism which are wholly mounted beneath the mailbox for movement between their inoperative and operative positions beneath the mailbox and without any lateral projections beyond the walls of the door of the mailbox. Accordingly, this mailbox signal and all of its components are not only protected from the weather, but are not exposed to damage or to provoke accident or vandalism, and are exposed to a minimum of view, except when the signal flag is in its operative position below the mailbox.

Essentially, the mailbox signal made in accordance with this invention, incorporates a flag member which is pivotally mounted beneath the bottom wall of the mailbox for swinging movement between an elevated, substantially horizontal position beneath the bottom wall and a depending exposed position. The flag member is held in its elevated inoperative position by a latch member, also pivotally mounted beneath the bottom wall of the mailbox, and having an abutment member depending into the swinging path of the bottom portion of the mailbox door when swung to a forward open position. No part of the latch member engages the mailbox door while the door is in its closed position, and therefore the door is free to swing independently of the mailbox signal or its actuating mechanism, until the bottom portion of the door actually engages the abutment member.

The mailbox signal further contemplates an extensible signal member hinged to the bottom, or free, end of the flag member. The extensible signal member is adapted to be folded flat on top of the flag member in its inoperative position, and to swing downward to an extended operative position when the flag member pivots downward.

The signal device further contemplates an electrical signal circuit having signal means, such as a lamp, remote from the mailbox, preferably in the home of the owner of the mailbox. The signal circuit includes a switch member mounted beneath the bottom wall of the mailbox in the swinging path of the flag member for actuation of the switch member by the flag member when it swings to its operative position.

DESCRIPTION OF THE PREFERRED EMBODIMENT

Figures 1, 2, 3, 4, 5:
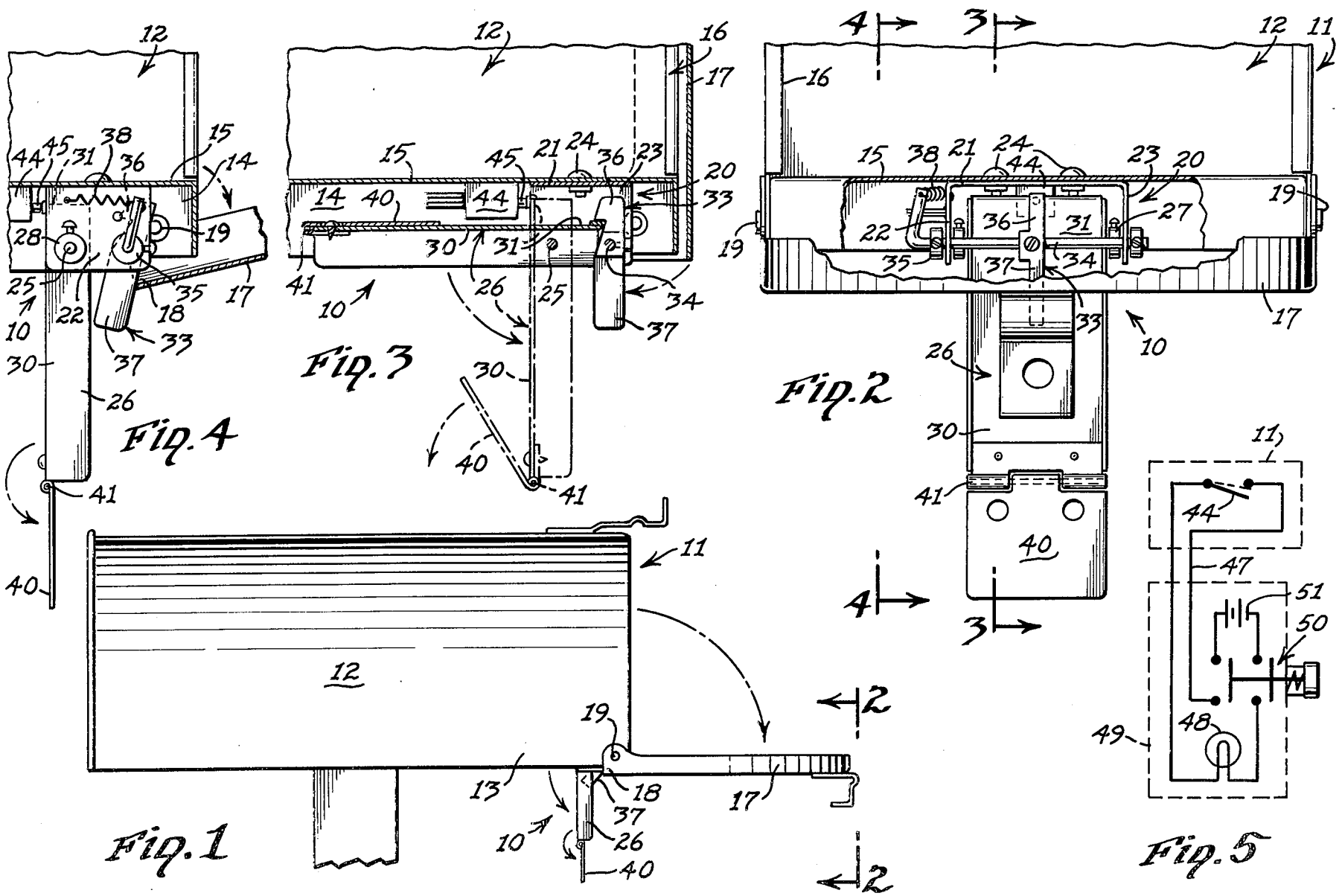
FIG. 1 is a side elevation of a mailbox upon which is mounted the mailbox signal, made in accordance with this invention, in operative position.
FIG. 2 is an enlarged, fragmentary, front view of the mailbox signal disclosed in FIG. 1, with parts broken away.
FIG. 3 is a fragmentary section taken along the line 3—3 of FIG. 2, with the mailbox signal in solid-line inoperative position and in phantom operative position.
FIG. 4 is a fragmentary section taken along the line 4—4 of FIG. 2, with the mailbox signal and extensible signal member in operative position.
FIG. 5 is a schematic diagram of the electrical signal circuit.

Referring now to the drawings in more detail, the mailbox signal device 10 made in accordance with this invention, is adapted to be mounted upon a conventional mailbox 11 including a housing 12 having a pair of side wall portions of flanges 13 and 14 depending below bottom wall 15. The mailbox 11 is also provided with a front opening 16 adapted to be closed by a front door 17 having a bottom portion 18 extending below the bottom wall 15 and journaled about hinge pins 19 projecting through the pending side wall flanges 13 and 14, respectively.

The signal device 10 includes a bracket 20 of inverted channel-shape, having a top wall 21 and a pair of depending side walls 22 and 23. The top wall 21 is fixed flush against the bottom wall 15 of the mailbox, by any convenient means, such as the pair of bolts 24, in a position spaced slightly behind the front door 17 of the mailbox.

Journaled through the side walls 22 and 23 is a main shaft 25 fixed transversely to, and extending laterally from both sides of, an elongated rectangular flag member 26. The main shaft 25 is fixed to the flag member 26 by means of the inside collars 27 (FIG. 2) and is journaled to the side walls 22 and 23 of the bracket 20 by means of the outside collars 28 (FIG. 4).

The flag member 26 is eccentrically mounted upon the shaft 25, that is the shaft 25 is spaced closer to the upper end than the lower end in order to divide the flag member 26 into a larger lower signal portion 30 and a smaller upper heel portion 31.

Spaced in front of the flag member 26 is a latch member 33 fixed to a transverse latch shaft 34 journaled through the side walls 22 and 23 of the bracket 20 and held in the journaled position by the outside collars 35. The latch member 33 has a smaller upper portion constituting a hook 36 and the larger or heavier lower portion constituting an abutment member 7. The heavier abutment member 37 causes the latch member 33 to normally occupy an upright position by gravity. If desired, the latch member 33 may be biased to an upright position by the action of spring 38 upon the extension of latch shaft 34.

The latch shaft 34 is spaced parallel to and in front of the main shaft 25. The spacing between shafts 34 and 25 is such that the hook 36 of the latch member 33 can securely engage and fit over the upper edge of the heel member 31 when the flag member 26 is disposed in the solid-line horizontal position of FIG. 3, thereby holding the flag member 26 in its horizontal, elevated, inoperative position.

The spacing of the shafts 25 and 34 from each other and also in relationship to the bottom portion 18 of the mailbox door 17, is also such that the abutment member 37 depends into the swinging path of the bottom door portion 18. Thus, when the door 17 swings forward from its closed position to a predetermined open position, such as that disclosed in solid lines in FIG. 4, the bottom portion 18 of the door 17 will engage and push rearward the abutment member 37, thereby pivoting the hook 36 forward to disengage the heel portion 31. The more massive signal portion 30 of the flag member 27 drops by gravity until the flag member 26 attains its vertical operative position, disclosed in solid lines in FIGS. 1 and 4, and in phantom in FIG. 3. The length of the signal portion 30 of the flag member 26 is great enough that it can be easily viewed at a substantial distance from the rear of the mailbox, such as from the owner's residence.

Thus, when the postman opens the mailbox door 17 and inserts mail, the bottom portion 18 of the door 17 actuates the latch member 33 to drop the flag member 26 and thereby apprise the homeowner of a mail delivery.

After the homeowner retrieves his mail from the mailbox, he can reset his signal device by swinging rearward the flag member 26 until the hook 36 of the latch member 33 re-engages the heel portion 31. The signal device 10 is then re-set for the next mail delivery.

In order to improve the visibility of the flag member 26 an extensible signal member 40 may be hinged about one end by hinge member 41 to the lower extremity of the signal portion 30, as illustrated in FIGS. 1–4. In its inoperative position the extensible signal member 40 is folded about the hinge member 41 to lie on top of the signal portion 30, as illustrated in solid lines in FIG. 3. However, when the signal device 10 is actuated to drop the flag member 26, the extensible member 40 swings freely about the hinge member 41 to drop down and form a downward extension of the signal portion 30 of the flag member 26, as illustrated in solid lines in FIGS. 1, 2 and 4.

In a further modification of the invention, a switch member, such as microswitch 44 may be fixed to the bottom surface of the bottom wall 15 or to an extension of the bracket top wall 21, immediately behind the heel portion 31 when the flag member 26 is actuated to drop to its vertical operative position, as illustrated in FIGS. 3 and 4. Actuation of microswitch 44 by the heel member 31 will close an electrical circuit (FIG. 5) including an electrical signal device, such as electrical lamp 48, located at a remote distance from the mailbox 11, such as in the mailbox owner's residence 49. The circuit 47 may also include a momentary push-button switch 50 connecting the electrical power source, such as battery 51, in series with the lamp 48 and the switch member 44.

Thus, when the homeowner does not desire to look out the window towards the mailbox, or cannot see the mailbox because of weather of obstructions, he may depress the push-button switch 50. If the lamp 48 illuminates, he will know that the signal device 10 has been actuated and that the mail has been delivered.

After the flag member 26 has been reset in its inoperative position, it automatically releases the switch button 45 and deactuates the switch member 44 to open the circuit 47.

It will be readily observed from the above description that the signal device 10 can be easily installed upon an existing and conventional mailbox by the mere connection of two bolts 24 to the bottom wall 15 in the proper location for engagement by the bottom door portion 18 of the abutment member 37 in order to actuate the flag member 26 upon opening of the front door 17.

The signal device 10 includes a minimum of inexpensive parts, and its critical location upon the bottom wall 15 of the mailbox immediately behind the front door 17 provides it with an exceptionally desirable protected and obscure position, the advantages of which have already been described.

What is claimed is:

1. In a mailbox having a bottom wall, a front opening and a door having a bottom portion below the level of said bottom wall, said bottom portion being journaled about a transverse axis for swinging movement between an upright position closing said front opening and an extended forward open position, a signal device comprising:

(a) a flag member journaled to said mailbox beneath said bottom wall about a horizontal main axis, eccentrically, to form an elongated signal portion on one side of said main axis and a heel portion on the opposite of said main axis, said signal portion having a greater moment about said main axis than said heel portion, (b) a latch member journaled to said mailbox beneath said bottom wall about a horizontal transverse axis to form a hook on one side of said transverse axis and an abutment member on the other side of said transverse axis, (c) said hook being adapted to engage said heel portion to hold said signal portion in an elevated inoperative position, (d) said abutment member being spaced behind and in the swinging path of the bottom portion of said door, (e) said abutment member being adapted to be engaged and moved by said bottom portion when said door swings to a predetermined forward open position, causing said hook to disengage said heel portion to permit said flag member to swing down about said main axis to expose said signal portion to view in operative position.

2. The invention according to claim 1 further comprising a bracket fixed to said bottom wall and having side walls depending below said bottom wall, first journal means for journaling said flag member between said side walls, about said main axis, and second journal means for journaling said latch member between said side walls about said transverse axis spaced parallel to and in front of said main axis.

3. The invention according to claim 1, further comprising spring means biasing said hook toward engagement with said heel portion.

4. The invention according to claim 1, in which said signal portion has a free end portion opposite said main axis, and further comprising an extension signal member, means journaling said extension signal member to said free end portion whereby said extension signal member may be folded upon the upper surface of said signal portion when said flag member is in said inoperative position, said extension member being adapted to swing away from said signal portion to a depending position below said signal portion in said operative position.

5. The invention according to claim 1, further comprising an electrical signal circuit having an electrical power source and electrical signal means remote from said mailbox, a switch member in said signal circuit mounted on said mailbox in the swinging path of said heel portion, said switch member being adapted to be actuated by said heel member when said heel member swings to its operative position, to energize said signal means.

* * * * *